US006010989A

United States Patent [19]

Krull et al.

[11] Patent Number: 6,010,989

[45] Date of Patent: Jan. 4, 2000

[54] ADDITIVE FOR IMPROVING THE FLOW PROPERTIES OF MINERAL OILS AND MINERAL OIL DISTILLATES

[75] Inventors: Matthias Krull, Oberhausen; Werner Reimann, Frankfurt, both of Germany

[73] Assignee: Clariant GmbH, Frankfurt, Germany

[21] Appl. No.: 09/148,933

[22] Filed: Sep. 4, 1998

[30] Foreign Application Priority Data

Sep. 8, 1997 [DE] Germany ..... 197 39 271

[51] Int. Cl.[7] ..... C10M 145/10; C10L 1/18

[52] U.S. Cl. ..... 508/475; 508/492; 508/496; 508/579; 44/393; 44/398; 44/447

[58] Field of Search ..... 508/475, 579

[56] References Cited

U.S. PATENT DOCUMENTS

| | | | |
|---|---|---|---|
| 3,250,714 | 5/1966 | Ilnyckyj et al. | 508/475 |
| 3,324,034 | 6/1967 | Merz et al. | 508/475 |
| 3,467,597 | 9/1969 | Tunkel et al. | 508/475 |
| 3,567,639 | 3/1971 | Aaron et al. | 508/475 |
| 3,764,537 | 10/1973 | Macleod | 508/475 |
| 3,947,368 | 3/1976 | Sweeney | 508/475 |
| 4,019,878 | 4/1977 | Wisotsky | 44/393 |
| 4,210,424 | 7/1980 | Feldman et al. | 44/394 |
| 4,431,565 | 2/1984 | Billenstein et al. | 516/183 |
| 4,661,120 | 4/1987 | Carr et al. | 44/394 |
| 4,670,516 | 6/1987 | Sackmann et al. | 525/327.6 |
| 4,793,939 | 12/1988 | Mori et al. | 508/579 |
| 5,071,445 | 12/1991 | Oppenlaender et al. | 49/408 |
| 5,186,720 | 2/1993 | Feustel et al. | 44/351 |
| 5,200,484 | 4/1993 | Reimann | 526/331 |
| 5,205,839 | 4/1993 | Reimann | 44/393 |
| 5,254,652 | 10/1993 | Reimann et al. | 526/331 |
| 5,376,155 | 12/1994 | Dralle-Voss et al. | 44/408 |
| 5,391,632 | 2/1995 | Krull et al. | 525/327.6 |
| 5,585,337 | 12/1996 | Day et al. | 508/466 |
| 5,705,603 | 1/1998 | Krull et al. | 508/221 |

FOREIGN PATENT DOCUMENTS

| | | |
|---|---|---|
| 9057910 | 1/1991 | Australia . |
| 0661894 | 10/1982 | European Pat. Off. . |
| 0104015 | 3/1984 | European Pat. Off. . |
| 0153176 | 8/1985 | European Pat. Off. . |
| 0154177 | 9/1985 | European Pat. Off. . |
| 0203554 | 12/1986 | European Pat. Off. . |
| 0254284 | 1/1988 | European Pat. Off. . |
| 0283293 | 9/1988 | European Pat. Off. . |
| 0398101 | 11/1990 | European Pat. Off. . |
| 0413279 | 2/1991 | European Pat. Off. . |
| 04361651 | 7/1991 | European Pat. Off. . |
| 0463518 | 1/1992 | European Pat. Off. . |
| 0485774 | 5/1992 | European Pat. Off. . |
| 0491225 | 6/1992 | European Pat. Off. . |
| 0493769 | 7/1992 | European Pat. Off. . |
| 0597278 | 5/1994 | European Pat. Off. . |
| 0606055 | 7/1994 | European Pat. Off. . |
| 0673990 | 9/1995 | European Pat. Off. . |
| 0688796 | 12/1995 | European Pat. Off. . |
| 0733694 | 9/1996 | European Pat. Off. . |
| 3142955 | 5/1983 | Germany . |
| 3443475 | 5/1986 | Germany . |
| 4019623 | 1/1991 | Germany . |
| 2189251 | 10/1987 | United Kingdom . |
| 2308129 | 6/1997 | United Kingdom . |
| WO 96/18708 | 6/1996 | WIPO . |

OTHER PUBLICATIONS

European Search Report.

Derwent Patent Family Report and/or Abstracts.

Comb–like polymers—Structure and Properties; N.A. Platé and V.P. Shibaev, J. Polym. Sci. Macromolecular Revs. 1974, 8, 117ff.

*Primary Examiner*—Ellen M. McAvoy

*Attorney, Agent, or Firm*—Miles B. Dearth

[57] ABSTRACT

The invention relates to an additive for improving the flow properties of paraffin-containing mineral oils and mineral oil distillates, comprising a mixture of at least one ethylene/vinyl ester copolymer or terpolymer and at least one paraffin dispersant, wherein said mixture contains ethers and/or esters as solubilizers, where a) the ethers conform to the formula 1

$$R—O—R' \quad (1)$$

in which R is a linear or branched alkyl or alkenyl group having 4 to 30 carbon atoms, and R' is a linear or branched alkyl or alkenyl group having 1 to 30 carbon atoms, b) the esters are derived from monobasic or polybasic carboxylic acids having 4 to 30 carbon atoms (acid radical) and from monohydric or polyhydric alcohols having 1 to 30 carbon atoms (alcohol radical), or c) the ethers and/or esters are cyclic, with a ring size of from 6 to 30 carbon atoms.

The invention furthermore relates to a process for improving the flow properties of mineral oils and mineral oil distillates which comprises adding the novel additive thereto.

9 Claims, No Drawings

ADDITIVE FOR IMPROVING THE FLOW PROPERTIES OF MINERAL OILS AND MINERAL OIL DISTILLATES

BACKGROUND OF THE INVENTION

The invention relates to an additive for improving the flow properties of paraffin-containing mineral oils and mineral oil distillates, containing flow improvers based on ethylene-vinyl ester copolymers and terpolymers, polar nitrogen compounds and ethers and/or esters as solubilizers.

Crude oils and middle distillates obtained by distillation of crude oils, such as gas oil, diesel oil or heating oil, contain, depending on the origin of the crude oils, various amounts of n-paraffins, which, when the temperature is reduced, crystallize out as platelet-shaped crystals and in some cases agglomerate with inclusion of oil. This crystallization and agglomeration causes an impairment of the flow properties of the oils or distillates, which can result in problems during the recovery, transport, storage and/or use of the mineral oils and mineral oil distillates. During transport of mineral oils through pipelines, the crystallization phenomenon can cause deposits on the walls of the pipes, especially in winter, and in individual cases, for example during stoppage in a pipeline, can even cause complete blocking thereof. During storage and further processing of the mineral oils, it may furthermore be necessary in winter to store the mineral oils in heated tanks. In the case of mineral oil distillates, the crystallization may result in blockage of the filters in diesel engines and furnaces, preventing reliable metering of the fuels and in some cases causing complete interruption of the supply of the fuel or heating medium.

In addition to the classical methods of eliminating the crystallized paraffins (thermal, mechanical or using solvents), which merely involve removal of the precipitates which have already formed, recent years have seen the development of chemical additives (so-called flow improvers), which, by interacting physically with the precipitating paraffin crystals, result in their shape, size and adhesion properties being modified. The additives act as additional crystal nuclei and in some cases crystallize with the paraffins, resulting in an increased number of relatively small paraffin crystals having a modified crystal shape. The modified paraffin crystals have a lower tendency toward agglomeration, so that the oils to which these additives have been added can still be pumped and/or processed at temperatures which are frequently more than 20° lower than in the case of oils containing no additives.

Typical flow improvers for crude oils and middle distillates are copolymers and terpolymers of ethylene with carboxylates of vinyl alcohol.

A further object of flow improver additives is dispersion of the precipitated paraffin crystals, i.e. inhibition or prevention of sedimentation of the paraffin crystals and thus of the formation of a paraffin-rich layer at the base of storage tanks.

The prior art discloses, inter alia, polar nitrogen compounds as paraffin dispersants. These can generally be used together with copolymers or terpolymers of ethylene and vinyl esters as additives to mineral oils and mineral oil distillates.

However, the use, in many cases desired, of concentrates of polar nitrogen compounds as paraffin dispersants together with copolymers and terpolymers of ethylene and vinyl esters encounters technical difficulties, since these substances have only very poor solubility in one another. The prior art therefore proposes various solubilizers, but their action is frequently unsatisfactory.

DE-A-40 19 623 discloses crystallization inhibitors for paraffins in petroleum fractions comprising fatty amines and solutions of benzoic and formic acids in methanol, ethanol, cyclohexanol or isopropanol.

EP-A-0 104 015 discloses the use of weak organic acids, in particular aromatic acids, such as benzoic acids, alkylphenols and alkarylsulfonin acids, for improving the solubility of nitrogen compounds in oils.

U.S. Pat. No. 4,210,424 discloses the use of polymers derived from carboxylic esters and carrying alkyl side chains having 6 to 30 carbon atoms, and/or from $C_8$–$C_{18}$-alkanols as solubilizers in compositions comprising ethylene copolymers, paraffin waxes and nitrogen compounds.

EP-A-0 733 694 discloses solvent mixtures of aliphatic or alicyclic alcohols having at least 4 carbon atoms and aromatic hydrocarbons in a ratio of from 10:1 to 1:2. The solvents are used to form a homogeneous mixture together with oil-soluble additives containing NR groups, where R is a hydrocarbon radical having 8 to 40 carbon atoms.

The object was therefore to find more efficient solubilizers between the polar nitrogen compounds and the ethylene/vinyl ester copolymers and terpolymers.

Surprisingly, it has been found that ethers and esters and mixtures thereof are excellent solubilizers for these flow improver combinations.

SUMMARY OF THE INVENTION

The invention relates to an additive for improving the flow properties of paraffin-containing mineral oils and mineral oil distillates, comprising a mixture of at least one ethylene/vinyl ester copolymer or terpolymer and at least one paraffin dispersant, wherein said mixture contains ethers and/or esters as solubilizers, where a) the ethers conform to the formula 1

$$R—O—R' \quad (1)$$

in which R is a linear or branched alkyl or alkenyl group having 4 to 30 carbon atoms, and R' is a linear or branched alkyl or alkenyl group having 1 to 30 carbon atoms, b) the esters are derived from monobasic or polybasic carboxylic acids having 4 to 30 carbon atoms (acid radical) and from monohydric or polyhydric alcohols having 1 to 30 carbon atoms (alcohol radical), or c) the ethers and/or esters are cyclic, with a ring size of from 6 to 30 carbon atoms.

The invention furthermore relates to a process for improving the flow properties of mineral oils and mineral oil distillates, which comprises adding the novel additive thereto.

R and the acid radical are preferably linear or branched alkyl or alkenyl groups having 5 to 22 carbon atoms. R' and the alcohol radical are preferably linear or branched alkyl or alkenyl groups having 2 to 22 carbon atoms.

DESCRIPTION OF THE PREFERRED EMBODIMENTS

Examples of suitable ethers are dihexyl ether, dioctyl ether and di-(2-ethylhexyl) ether, and examples of suitable esters are eicosyl oleate, 2-ethylhexyl stearate, 2-ethylhexyl butyrate, ethyl octanoate, ethyl hexanoate, butyl 2-ethylhexanoate, 2-ethylhexyl butyrate and 2-ethylhexyl 2-ethylhexanoate.

In a further preferred embodiment of the invention, R and R' or the acid and alcohol radicals form a ring having 8 to 22 ring members.

If the solubilizers are esters, the use of monoesters and diesters of both dialcohols and dicarboxylic acids is preferred. Examples of suitable esters are di(2-ethylhexyl) adipates, 2-ethylhexane-1,3-diol mono-n-butyrate, and 2-ethylhexane-1,3-diol di-n-butyrate.

It is furthermore preferred to add, in addition to the ethers and/or esters, up to 30% by weight of alkylphenol-aldehyde resins and/or up to 10% by weight of alcohols, aldehydes and/or acetals (in each case based on the total composition) to the additive. The mixtures may furthermore contain aliphatic and/or aromatic solvents.

In a preferred embodiment of the invention, ether- and ester-containing mixtures, as formed, for example, as byproduct in the oxo synthesis, are used.

In a further preferred embodiment of the invention, a solvent mixture originating from the oxo synthesis, referred to below as MS, is added as solubilizer.

MS is a mixture from the series consisting of aliphatic and cyclic, non-aromatic hydrocarbons. The principal constituents of MS are shown in the table below:

| Constituent | Concentration range (% by wt.) |
|---|---|
| Di-2-ethylhexyl ether | 10–25 |
| 2-Ethylhexyl 2-ethylhexanoate | 10–25 |
| $C_{16}$ lactones | 4–20 |
| 2-Ethylhexyl butyrate | 3–10 |
| 2-Ethylhexane-1,3-diol mono-n-butyrate | 5–15 |
| 2-Ethylhexanol | 4–10 |
| $C_4$- to $C_8$-acetals | 2–10 |
| 2-Ethylhexane-1,3-diol | 2–5 |
| Ethers and esters $\geqq C_{20}$ | 0–20 |

Suitable ethylene-vinyl ester copolymers and terpolymers are all known copolymers and terpolymers of this type and mixtures thereof which separately improve the cold-flow properties of mineral oils and mineral oil distillates. Examples of suitable copolymers and terpolymers are the following:

ethylene-vinyl acetate copolymers containing 10–40% by weight of vinyl acetate and 60–90% by weight of ethylene;

the ethylene-vinyl acetate-hexene terpolymers disclosed in DE-A-34 43 475;

the ethylene-vinyl acetate-diisobutylene terpolymers described in EP-A-0 203 554;

the mixture of an ethylene-vinyl acetate-diisobutylene terpolymer and an ethylene-vinyl acetate copolymer disclosed in EP-A-0 254 284;

the mixtures of an ethylene-vinyl acetate copolymer and an ethylene-vinyl acetate-N-vinylpyrrolidone terpolymer disclosed in EP-A-0 405 270;

the ethylene-vinyl acetate-i-butyl vinyl ether terpolymers described in EP-A-0 463 518;

the copolymers of ethylene and vinyl alkylcarboxylates disclosed in EP-A-0 491 225;

the ethylene-vinyl acetate-vinyl neononanoate or vinyl neodecanoate terpolymers disclosed in EP-A-0 493 769, which, in addition to ethylene, contain 10–35% by weight of vinyl acetate and 1–25% by weight of the respective neo compound;

the terpolymers of ethylene, the vinyl ester of one or more aliphatic $C_2$–$C_{20}$-monocarboxylic acids and 4-methyl-1-pentene described in DE-A-196 20 118; and the terpolymers of ethylene, the vinyl ester of one or more aliphatic $C_2$–$C_{20}$-monocarboxylic acids and bicyclo [2.2.1]hept-2-ene disclosed in the German patent application having the file reference 196 20 119.5, which is not a prior-art publication.

Preference is given to ethylene-vinyl ester copolymers or terpolymers having an ethylene content of 60–90% by weight, and mixtures thereof.

Particularly preferred terpolymers of ethylene and vinyl esters are those which, in addition to from 65 to 94 mol % of structural units derived from ethylene and from 5 to 35 mol % of structural units derived from vinyl acetate, also contain from 1 to 25 mol % of structural units of the formula (2)

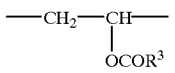

(2)

in which $R^3$ is saturated, branched $C_6$–$C_{16}$alkyl containing a tertiary carbon atom. In addition to said monomer units, the copolymers and terpolymers used for the additive mixture can also contain up to 5 mol % of monomer units derived from olefins, such as, for example, vinyl ethers, alkyl acrylates, alkyl methacrylates, isobutylene or higher olefins having at least 5 carbon atoms, such as, for example, hexene, 4-methylpentene, octene or diisobutylene.

Examples of suitable paraffin dispersants are polar, low-molecular-weight or polymeric oil-soluble compounds which contain one or more ester, amide and/or imide groups substituted by at least one $C_8$–$C_{26}$-alkyl chain and/or carry one or more ammonium groups derived from amines having one or two $C_8$–$C_{26}$-alkyl groups.

Of the abovementioned paraffin dispersants, preference is given to the polar nitrogen-containing compounds.

Examples of monomeric polar nitrogen-containing compounds which can be used are the following substances:

EP-A-0 413 279 describes suitable products of the reaction of alkenylspirobislactones with amines.

The oil-soluble products of the reaction of phthalic anhydride with amines which are disclosed in EP-A-0 061 894 can also be used in the form of a mixture with ethylene-vinyl acetate copolymers.

The products of the reaction of aminoalkylene carboxylic acids with primary or secondary amines which are disclosed in EP-A-0 597 278 are furthermore suitable as monomeric nitrogen-containing compounds.

The polymeric polar nitrogen-containing compounds are preferably copolymers or terpolymers based on α,β-unsaturated compounds and maleic acid. The following are suitable, for example:

The products of the reaction of alternating copolymers based on α,β-unsaturated compounds and maleic anhydride with primary monoalkylamines and aliphatic alcohols which are disclosed in EP-A-0 154 177;

the products of the reaction of copolymers based on maleic anhydride and α,β-unsaturated compounds, such as styrene, with dialkylamines which are disclosed in EP-A-0 436 151;

the copolymers based on aliphatic olefins and maleic anhydride which are disclosed in EP-A-0 283 293, where the copolymer contains both ester amide groups, each of which contains an alkyl group having at least 10 carbon atoms;

the products of the reaction of copolymers based on maleic anhydride and α,β-unsaturated compounds, such as styrene, with dialkylamines which are disclosed in EP-A-0 436 151;

the terpolymers based on α,β-unsaturated dicarboxylic anhydrides, α,β-unsaturated compounds and polyoxyalkylene ethers of lower, unsaturated alcohols which are described in EP-A-0 606 055;

the copolymers based on α,β-unsaturated olefins having at least 3 carbon atoms and α,β-unsaturated dicarboxylic anhydrides, which are disclosed in EP-A-0 688 796, where the dicarboxylic anhydride units have been converted into imide, amide and ammonium units by polymer-analogous reaction with polyether amines or alkanolamines;

the random copolymers and terpolymers based on ethylene, α,β-unsaturated dicarboxylic anhydrides and, if desired, further α,β-unsaturated compounds which are described in the German patent application having the file reference 196 45 603.7, which is not a prior-art publication, where a high proportion of the dicarboxylic anhydride units is in the form of imide units and a smaller proportion thereof is in the form of amide/ammonium salt units.

The novel mixtures are added in the form of concentrates to mineral oils or mineral oil distillates. These concentrates preferably contain from 1 to 70% by weight, in particular from 5 to 60% by weight, of vinyl ester copolymers and paraffin dispersants in a ratio of from 1:10 to 10:1, in particular in the ratio of from 1:5 to 5:1 and from 1 to 60% by weight, in particular from 5 to 50% by weight, of the solvents according to the invention. The remainder to 100% by weight can be made up by aliphatic, aromatic solvents and alkylphenol resins, alcohols, aldehydes and/or acetals. Mineral oils or mineral oil distillates whose rheological properties have been improved by the novel mixtures contain from 0.001 to 2% by weight, preferably from 0.005 to 0.5% by weight, of the mixtures, based on the distillate. The same result, namely optimization of the effectiveness as flow improvers for certain substrates, can also be achieved by the novel mixtures together with one or more oil-soluble coadditives which separately improve the cold-flow properties of crude oils, lubricant oils or fuel oils, for example comb polymers. The term comb polymers is taken to mean polymers in which hydrocarbon radicals having at least 8 carbon atoms, in particular having at least 10 carbon atoms, are bonded to a polymer backbone. These are preferably homopolymers whose alkyl side chains contain at least 8 and in particular at least 10 carbon atoms. In the case of copolymers, at least 20%, preferably at least 30%, of the monomers have side chains (cf. Comb-like polymers-Structure and Properties; N.A. Platéand V. P. Shibaev, J. Polym. Sci. Macromolecular Revs. 1974, 8, 117 ff.). Examples of suitable comb polymers are fumarate-vinyl acetate copolymers (cf. EP-A-0 153 176), copolymers of a $C_6$–$C_{24}$-α-olefin and an N—$C_6$- to $C_{22}$-alkylmaleimide (cf. EP-A-0 320 766), furthermore esterified olefin-maleic anhydride copolymers, polymers and copolymers of α-olefins and esterified copolymers of styrene and maleic anhydride.

The mixing ratio (in parts by weight) of the novel mixtures with comb polymers is from 1:10 to 20:1, preferably from 1:1 to 10:1.

The novel mixtures are suitable for improving the cold-flow properties of animal, vegetable or mineral oils. They are particularly suitable for use with middle distillates. The term middle distillates is taken to mean, in particular, mineral oils which have been obtained by distillation of crude oil and boil in the range from 120° to 450° C., for example kerosene, jet fuel, diesel and heating oil. The concentrates have a significantly improved shelf life, in particular at low temperatures.

The novel mixtures can be used alone or together with other additives, for example dewaxing auxiliaries, corrosion inhibitors, antioxidants, lubricity additives or sludge inhibitors. These additives can be added to the oil together with the novel mixture or separately.

EXAMPLES

A) Ethylene-vinyl acetate copolymer containing 31% by weight of vinyl acetate and having a melt viscosity of 160 mPas measured at 140° C., 58% strength in kerosene.

B) Ethylene-vinyl acetate-vinyl versatate terpolymer containing 31% by weight of vinyl acetate and 4% by weight of vinyl versatate and having a melt viscosity of 180 mPas measured at 140° C.

C) Product of the reaction of a terpolymer of $C_{14/16}$-α-olefin, maleic anhydride and allyl polyglycol with 2 equivalents of ditalo fatty amine, 50% strength by weight in solvent naphtha (as described in EP-A-0606055).

D) Nonylphenol-formaldehyde resin as described in DE-A-3142955, prepared by acid-catalyzed condensation of p-nonylphenol and formaldehyde, 50% strength in solvent naphtha.

E) Mixture of C and D in the ratio 1:1.

F) Amide-ammonium salts of a spirobislactone as described in EP-A-0413279, 50% strength by weight in solvent naphtha.

MS) Solvent mixture comprising the following principal components:

| | |
|---|---|
| Di-2-ethylhexyl ether | 20% |
| 2-Ethylhexyl 2-ethylhexanoate | 14% |
| $C_{16}$ lactones | 17% |
| 2-Ethylhexane-1,3-diol mono-n-butyrate | 10% |
| 2-Ethylhexyl butyrate | 5% |
| 2-Ethylhexanol | 5% |
| $C_4$- to $C_8$-acetals | 10% |
| Ethers/esters ≧ $C_{20}$ | 19% |

The above active ingredients are homogenized at 80° C. with stirring in the amounts shown in Tables 1 and 2. The stability of the solutions after storage for 3 days at room temperature or at 60° C. is then assessed visually.

TABLE 1

Ethers and esters as solubilizers. All data in % by weight.

| A | B | C | F | E | Solubilizer | 23° C. | 60° C. |
|---|---|---|---|---|---|---|---|
| 50 | | 50 | | | - (comparison) | 2-phase | 2-phase |
| 50 | | | 50 | | - (comparison) | 2-phase | 2-phase |
| 50 | | | | 50 | - (comparison) | 2-phase | 2-phase |
| 67 | | | | 33 | - (comparison) | 2-phase | 2-phase |
| 40 | | | | 40 | 20% kerosene (comparison) | 2-phase | cloudy |
| 40 | | 40 | | | 20% kerosene (comparison) | 2-phase | clear |
| 40 | | | | 40 | 20% solvent naphtha (comparison) | 2-phase | cloudy |

TABLE 1-continued

Ethers and esters as solubilizers. All data in % by weight.

| A | B | C | F | E | Solubilizer | 23° C. | 60° C. |
|---|---|---|---|---|---|---|---|
| 40 | | | 40 | | 20% solvent naphtha (comparison) | 2-phase | cloudy |
| 60 | | | | 30 | 10% MS | cloudy, homogeneous | cloudy, homogeneous |
| 40 | | 40 | | | 20% MS | cloudy, homogeneous | clear, homogeneous |
| 40 | | | | 40 | 20% MS | cloudy, homogeneous | clear, homogeneous |
| 53 | | | | 27 | 20% MS | cloudy, homogeneous | clear, homogeneous |
| 40 | | 40 | | | 20% dihexyl ether | cloudy, homogeneous | clear, homogeneous |
| 40 | | | 40 | | 20% dihexyl ether | cloudy, homogeneous | clear, homogeneous |
| 40 | | | | 40 | 20% dihexyl ether | cloudy, homogeneous | clear, homogeneous |
| 53 | | | | 27 | 20% dihexyl ether | cloudy, homogeneous | clear, homogeneous |
| 40 | | 40 | | | 20% di(2-EH) adipate | cloudy, homogeneous | clear, homogeneous |
| 40 | | | 40 | | 20% di(2-EH) adipate | cloudy, homogeneous | clear, homogeneous |
| 40 | | | | 40 | 20% di(2-EH) adipate | cloudy, homogeneous | clear, homogeneous |
| 53 | | | | 27 | 20% di(2-EH) adipate | cloudy, homogeneous | clear, homogeneous |
| 40 | | | | 40 | 20% ethyl hexanoate | cloudy, homogeneous | clear, homogeneous |
| 53 | | | | 27 | 20% ethyl octanoate | cloudy, homogeneous | clear, homogeneous |
| | 25 | | | 50 | 25% MS | clear, homogeneous | clear, homogeneous |
| | 34 | | | 33 | 33% MS | cloudy, homogeneous | clear, homogeneous |
| | 25 | | | 50 | 25% dihexyl ether | clear, homogeneous | clear, homogeneous |
| | 34 | | | 33 | 33% dihexyl ether | cloudy, homogeneous | clear, homogeneous |
| | 25 | | | 50 | 25% di(2-EH) adipate | cloudy, homogeneous | clear, homogeneous |
| | 34 | | | 33 | 33% di(2-EH) adipate | cloudy, homogeneous | cloudy, homogeneous |
| 53 | | | | 27 | 20% eicosyl oleate | cloudy, homogeneous | clear, homogeneous |
| 53 | | 27 | | | 20% 2-ethyl-hexyl stearate | cloudy, homogeneous | clear, homogeneous |
| 53 | | | 27 | | 20% 2-ethyl-hexyl stearate | cloudy, homogeneous | clear, homogeneous |
| 53 | | | | 27 | 20% 2-ethyl-hexyl stearate | cloudy, homogeneous | clear, homogeneous |

On re-warming, the novel mixtures remain homogeneous.

List of trade names used

| | |
|---|---|
| Solvent naphtha ® Shellsol AB ® Solvesso 150 | aromatic solvent mixtures having a boiling range of from 180 to 210° C. |
| ® Solvesso 200 | aromatic solvent mixture having a boiling range of from 230 to 287° C. |
| ® Exxsol | dearomatized solvent in various boiling ranges, for example ® Exxsol D60: 187 to 215° C. |
| ® ISOPAR (Exxon) | isoparaffinic solvent mixtures in various boiling ranges, for example ® ISOPAR L: 190 to 210° C. |
| ® Shellsol D | principally aliphatic solvent mixtures in various boiling ranges |

We claim:

1. An additive for improving the flow properties of paraffin-containing mineral oils and mineral oil distillates comprising:

an admixture of at least one ethylene vinyl ester copolymer or terpolymer;

at least one paraffin dispersant; and at least one solubilizer selected from the group consisting of:

(1) ethers conforming to the formula R—O—R' in which R is a linear or branched alkyl or alkenyl group having 4 to 30 carbon atoms and R' is a linear or branched alkyl or alkenyl group having 1 to 30 carbon;

(2) cyclic ethers with a ring size of 6–30 carbon atoms;

(3) cyclic esters with a ring size of 6–30 carbon atoms;

(4) esters formed from (i) an acid radical that is a monobasic or polybasic carboxylic acid with 4–30 carbon atoms and (ii) a monohydric or polyhydric alcohol radical having 1 to 30 carbon atoms.

2. An additive as claimed in claim 1, wherein the radicals R and/or the acid radical have from 5 to 22 carbon atoms and the radicals R' and/or the alcohol radical have from 2 to 22 carbon atoms.

3. An additive as claimed in claim 1, wherein the solubilizer is a solvent mixture comprising the following principal components:

20% di-2-ethylhexyl ether, 14% 2-ethylhexyl 2-ethylhexanoate,

17% $C_{16}$lactones, 10% 2-ethylhexane-1,3-diol mono-n-butyrate

5% 2-ethylhexyl butyrate, 5% 2-ethylhexanol, 10% $C_4$- to $C_8$-acetals, and

19% ethers/esters$\geqq C_{20}$.

4. An additive as claimed in claim 1, which additionally contains alcohols and/or alkylphenol-aldehyde resins.

5. An additive as claimed in claim 1, which contains a terpolymer of ethylene, vinyl acetate and of structural units having the formula (2)

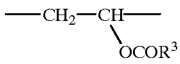

(2)

wherein $R^3$ is saturated, branched $C_6$–$C_{16}$-alkyl containing a tertiary carbon atom.

6. A process for improving the flow properties of mineral oils and mineral oil distillates, which comprises adding the admixture as claimed in claim 1.

7. A mineral oil and mineral oil distillate containing the admixture as claimed in claim 1.

8. An additive as claimed in claim 1 wherein said paraffin dispersant is a polar nitrogen compound substituted by at least one $C_8$–$C_{26}$-alkyl chain.

9. An additive as claimed in claim 1 wherein said ethylene vinyl ester terpolymer consists of ethylene, the vinyl ester of one aliphatic $C_2$–$C_{20}$-monocarboxylic acid and a third monomer selected from the group consisting of 4-methyl-1-pentene and bicyclo[2.2.1]-hept-2-ene.

* * * * *